US012050019B2

(12) United States Patent
Cai

(10) Patent No.: US 12,050,019 B2
(45) Date of Patent: Jul. 30, 2024

(54) EASY-TO-INSTALL MULTI-PURPOSE COOLING AND HEATING MACHINE SYSTEM

(71) Applicant: Encheng Cai, Tianjin (CN)

(72) Inventor: Encheng Cai, Tianjin (CN)

( * ) Notice: Subject to any disclaimer, the term of this patent is extended or adjusted under 35 U.S.C. 154(b) by 0 days.

(21) Appl. No.: 18/035,887

(22) PCT Filed: Feb. 22, 2022

(86) PCT No.: PCT/CN2022/000026

§ 371 (c)(1),
(2) Date: May 8, 2023

(87) PCT Pub. No.: WO2022/183839

PCT Pub. Date: Sep. 9, 2022

(65) Prior Publication Data

US 2023/0408125 A1 Dec. 21, 2023

(30) Foreign Application Priority Data

Mar. 5, 2021 (WO) ..... PCT/CN2021/000035

(51) Int. Cl.
*F24F 11/63* (2018.01)

(52) U.S. Cl.
CPC ..... *F24F 11/63* (2018.01)

(58) Field of Classification Search
CPC ... F24F 11/63; F24F 5/00; F24F 12/00; F24H 4/04; F24H 7/02; F25B 29/00; F28D 20/02
See application file for complete search history.

(56) References Cited

U.S. PATENT DOCUMENTS

2021/0341170 A1* 11/2021 Hikawa ..... F25B 41/31
2022/0221176 A1* 7/2022 Rodrigues ..... F24F 8/22
(Continued)

FOREIGN PATENT DOCUMENTS

CN 200946946 Y 9/2007
CN 201407814 Y 2/2010
(Continued)

*Primary Examiner* — Nelson J Nieves
(74) *Attorney, Agent, or Firm* — Meunier Carlin & Curfman LLC

(57) ABSTRACT

Compared with an opposite arrangement of a cold system/a heat system in a traditional compression refrigeration household appliance, an automatic cold/heat balance storage operation system controlled by a cloud-networked microprocessor controller is added to an easy-to-install multi-purpose cooling and heating machine system, which has automatic cold/heat balance, self-heating and defrosting, and a plurality of modes of cold/heat storage. Cold/heat balance configuration achieves double-effect power conservation and outputs cold/heat in a plurality of modes The easy-to-install cooling and heating machine system includes: a cold/heat balancing heat exchanger, a cold/heat balancing self-defrosting cold/heat output machine, a cold/heat storage compensation equipment, and a cold/heat balance using equipment. The cold/heat storage compensation equipment includes: a hot water storage tank, a cold/heat storage tank, an ice/hot water storage tank, an ice/hot water energy storage tank, and a self-cycling hot cold water storage tank.

7 Claims, 4 Drawing Sheets

(56) References Cited

U.S. PATENT DOCUMENTS

| | | | | |
|---|---|---|---|---|
| 2022/0221196 | A1* | 7/2022 | Yoshimi | F24F 11/65 |
| 2022/0264809 | A1* | 8/2022 | Olafsson | A01G 9/247 |
| 2022/0316719 | A1* | 10/2022 | Theriault | F24F 13/20 |
| 2022/0364757 | A1* | 11/2022 | Cimberio | F24F 5/0003 |
| 2023/0013910 | A1* | 1/2023 | Mai | F24F 11/63 |
| 2023/0288089 | A1* | 9/2023 | Jackson | G05D 23/1927 |
| 2023/0296100 | A1* | 9/2023 | Taras | F24F 11/77 417/53 |
| 2023/0304696 | A1* | 9/2023 | Wu | F24F 11/86 |
| 2023/0332782 | A1* | 10/2023 | Fukumoto | F24F 6/16 |

FOREIGN PATENT DOCUMENTS

| | | | |
|---|---|---|---|
| CN | 102042713 | A | 5/2011 |
| CN | 202885134 | U | 4/2013 |
| CN | 104633977 | A | 5/2015 |
| CN | 206362035 | U | 7/2017 |
| JP | 2019128103 | A | 8/2019 |
| WO | 2022183306 | A1 | 9/2022 |

* cited by examiner

EASY-TO-INSTALL MULTI-PURPOSE COOLING AND HEATING MACHINE SYSTEM

CROSS-REFERENCE TO RELATED APPLICATION

This application is a national stage application of International Patent Application No. PCT/CN2022/000026, filed Feb. 22, 2022, which claims the benefit to claims the benefit and priority of International Patent Application No. PCT/CN2021/000035, filed on Mar. 5, 2021, the disclosure of which is incorporated by reference herein in its entirety.

SUMMARY

An easy-to-install multi-purpose cooling and heating machine system is provided. Compared with an opposite arrangement of a cold system/a heat system in a traditional compression refrigeration household appliance, the easy-to-install multi-purpose cooling and heating machine (PCT/CN2021/000035) designs and adds a third-party system. That is, an automatic cold/heat balance storage operation system is controlled by a microprocessor controller (1). An automatically controlled cold/heat balance device, a cold/heat balance heat exchanger (22), and a hot water storage tank of a balance storage compensation device (111) are designed and installed in an automatic cold/heat balance storage operation system of the easy-to-install multi-purpose cooling and heating machine. During design and installation, dual sources are required. Dual source media, that is, water-anti-freezing cooling medium/heat-carrying agent and refrigerant that are precisely controlled to operate by cold pies and hot pipes form a dual source cold-dry air heater/cooler (112) (512C). On the basis of the easy-to-install multi-purpose cooling and heating machine (PCT/CN2021/000035), the easy-to-install multi-purpose cooling and heating machine system designs a cloud network to manage and operate mechanisms and functions. That is, a cloud-networked microprocessor controller (01) (02) (03) . . . , a refrigeration compressor (201) (202) (203) . . . with a networking function, and equipment and components used for relevant connection operation mechanisms are all used. In the easy-to-install multi-purpose cooling and heating machine system, the operations of using, balancing, storing, compensating, and outputting the cold/heat, which is produced by compression refrigeration and heating, are all performed, so as to output to an external system under the instructions (designed based on the system's protocol) of the cloud-networked microprocessor controller (01) (02) (03) . . . . In this large system, any equipments or system can input/output buy/sale cool/heat based on demand and price follow the system rules. Main system adjusted operation of main control equipments according to actual demand and, adjusted the price of sale/buy cool/heat according to the rules. The easy-to-install multi-purpose cooling and heating machine system has the following characteristics.

1. The easy-to-install multi-purpose cooling and heating machine system has a plurality of modes such as cold/heat balance, self-heating and defrosting, and excellent cold/heat storage. Auxiliary machine balance configuration achieves double-effect power conservation and a plurality of functions. Cold/heat is output/input between auxiliary machines and host machines or other external system in a plurality of modes.

2. The refrigerant used by an easy-to-install cooling medium/heat-carrying agent machine is packaged at one time in a factory. A automobile anti-freezing solution (i.e., heat-carrying agent/cooling medium) or anti-freezing salt solution is used between a host machine and an auxiliary machine, the host machine and the auxiliary machine are connected by using a low pressure pipeline to perform the cycling of the cold/heat sources, and air pipes are used to provide cold-dry hot air and cold/hot air. The equipment is easy and convenient to install and migrate.

3. A refrigerant evaporator/condenser has a powerful networking function, and is comprehensively balanced and cross-used with the easy-to-install cooling medium/heat-carrying agent machine, so the efficiency is higher.

4. Distributed host machines are networked to achieve high power, which becomes a high-power cold/heat supply pipe network system. A net system with cold/heat supply pipes which is put into use by stages, has low investment, easiness in installation and maintenance, a plurality of functions, convenience in migration, more flexibility and high efficiency in use, operation, and management, and cloud-networked management and operation. Thus, it is formed to be a system with a net of cold and heat pipes, in which the cold and heat pipes are physically connected. So, this system is adapted for the development trends of function combination, internet of everything, cloud management, cost reduction, synergy, energy conservation, and emission reduction.

TECHNICAL FIELD

The present disclosure relates to an easy-to-install multi-purpose cooling and heating machine system which has the characteristics of balance, storage, self-heating, defrosting, double-effect energy conservation, multiple purposes, and easiness in installation, and this system produce cooling capacity heat at same time, then balance and offset each other, it is beneficial for controlling global climate change, and belongs to the field of environmental protection system and cooling/heating household appliance system and high power wide range combined large cold/heat supply pipe network system.

BACKGROUND

Compression refrigeration household appliances, such as air conditioners, refrigerators, and air energy heaters, are household appliances widely sold and used at present. However, generally, only one of the cold and heat produced by these products in a refrigeration and compression process is used, and the other is discharged, and the function is simple.

BRIEF DESCRIPTION OF THE DRAWINGS

Reference signs in all drawings are: cloud-networked microprocessor controller (01) (02) (03), large capacity refrigerant distribution box (3), normal temperature gas-refrigerant return box (8), heat-carrying agent cycling pump (9), heat-carrying agent outlet (10), heat-carrying agent return conversion solenoid valve (13), heat-carrying agent return box (14), tap water check valve inlet (15), cooling medium cycling pump (16), cooling medium outlet (17), cooling medium return box (18), cooling medium/heat-carrying agent storage box (19), low-level fluid supplementation pipe (20), high-level interconnecting pipe (21), cold/heat balance heat exchanger (22), gas-liquid separator (24), exhaust port/fan (82), air inlet screen (83), water filling/breathing port (84), drying cabinet (85), dry-hot/cold air outlet (89), high pressure and high temperature refrigerant connecting pipeline (90), connecting pipeline from normal temperature liquid refrigerant to refrigerant distribution box (91), connecting pipeline (92) for outputting a normal temperature liquid-refrigerant, connecting pipeline (93) to normal temperature gas-refrigerant return box, connecting pipeline (94) for outputting a heat-carrying agent, connecting pipeline (95) for returning a heat-carrying agent, connecting pipeline (96) for outputting a cooling medium, connecting pipeline (97) for returning a cooling medium, connecting pipeline (98) for cooling medium/heat-carrying agent to return to cooling medium/heat-carrying agent storage box, connecting pipeline (99) for outputting hot/cold water, connecting pipeline (100) for returning hot/cold water, refrigerator (104), evaporator/cold accumulator (105), condensation heat accumulator (106), air conditioner indoor unit (125), refrigeration compressor (201) with networking function, refrigeration compressor (202) with networking function, refrigeration compressor (203), with networking function cooling medium cold source refrigerator (304), draught fan (312C) with cooling medium as a cold source, dual-purpose machine (351) with cooling medium as a cold source, heat accumulator (506) with water condensation, water heater (506B) with condensation storage, cold-dry air heater/cooler (512C), dual component and dual temperature region cold/heat balance self-defrosting heat exchanger (512CD), solenoid regulation and control valve (653), refrigerator (704), hot water storage tank (711), control valve (713) for returning cooling medium in a hot water storage tank, dual component cold/heat balance self-defrosting heat exchanger (722), solenoid regulation and control valve (723), dual temperature region cold-dry hot/cold air conditioner indoor unit (725), cold/heat storage tank (756), ice/hot water storage tank (757), refrigerator-air conditioner-water heater multi-purpose machine (789), ice/hot water energy storage tank (811), dual component and dual pipeline cold/heat balance self-defrosting heat exchanger (822), self-cycling hot/cold water storage tank (911), cycling pump (916), self-balancing defrosting cold/heat output machine (2722), self-balancing defrosting cold/heat output machine (2821), easy-to-install multi-purpose cold/heat output machine (2822), dual component cold/heat balance self-defrosting heat-exchanger assembly A (A), dual component cold/heat balance self-defrosting heat-exchanger assembly B (B), dual source heat-exchanger cold pipe (L), and dual source heat-exchanger heat pipe (R).

Combination split line ( . . . + . . . )

DETAILED DESCRIPTION OF THE EMBODIMENTS

Figure 1:
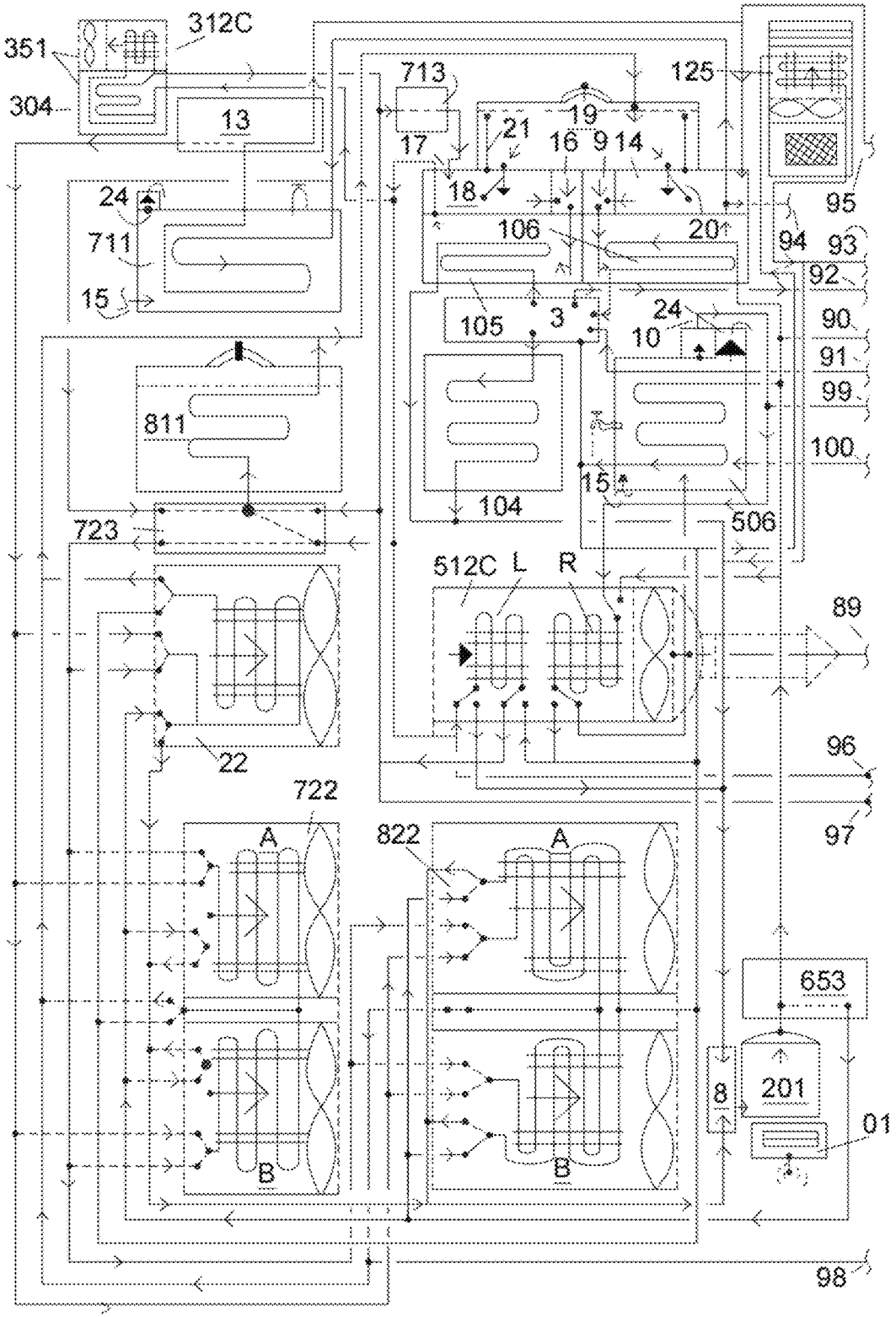
FIG. 1 is a schematic operation diagrams of an easy-to-install multi-purpose cooling and heating machine main system according to an embodiment of the present disclosure.
Figure 2:
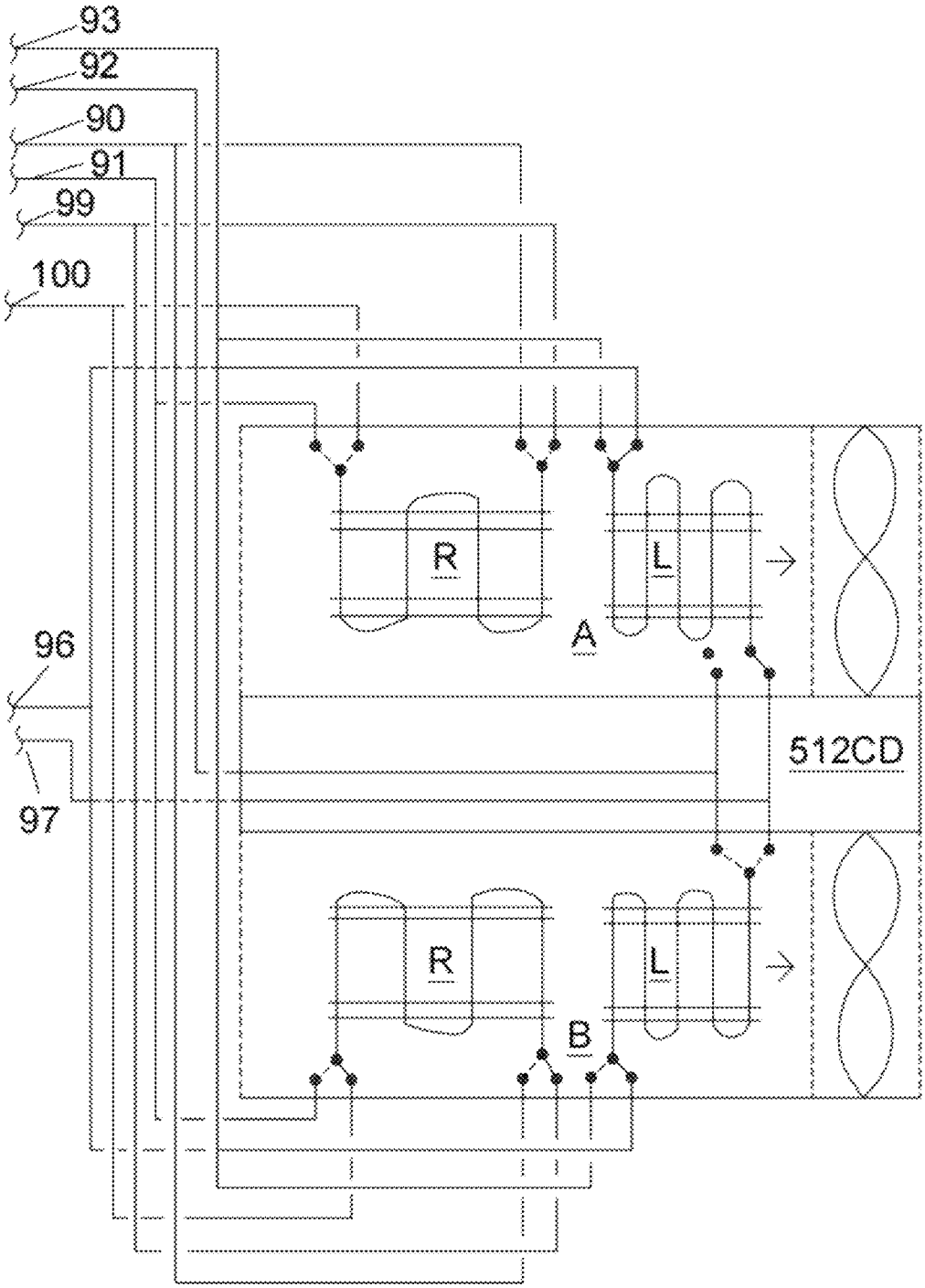
FIG. 2 is another schematic operation diagram of an easy-to-install multi-purpose cooling and heating machine main system according to an embodiment of the present disclosure.

FIGS. 1 and 2 are schematic operation diagrams of an easy-to-install multi-purpose cooling and heating machine main system.

An operation method of the main system of an easy-to-install multi-purpose cooling and heating machine includes: a cloud-networked microprocessor controller (01) starts; a cooling system starts to operate; a refrigeration compressor (201) sucks a normal temperature gas-refrigerant from a normal temperature gas-refrigerant gas return box (8); a high temperature and high pressure gas-refrigerant is compressed and discharged via the refrigeration compressor (201) to enable the high temperature and high pressure gas-refrigerant to flow into a cold-dry air heater/cooler (512C), a dual source heat-exchanger heat pipe (R) of the cold-dry air heater/cooler, a heat accumulator (506) with water condensation, and a condensation heat accumulator (106) in sequence through a high pressure and high temperature refrigerant connecting pipeline (90); after the high temperature and high pressure gas-refrigerant in the condensation heat accumulator (106) being condensed and heated to form a normal temperature liquid-refrigerant, the normal temperature liquid-refrigerant flows into a connecting pipeline of a refrigerant distribution box (91), and then passes through a large capacity refrigerant distribution box (3), a connecting pipeline (92) for outputting the normal temperature liquid-refrigerant, an evaporator/cold accumulator (105), a refrigerator (104), and an air conditioner indoor unit (125) in sequence; after the normal temperature liquid-refrigerant in the air conditioner indoor unit being evaporated and refrigerated to form a normal temperature gas-refrigerant, the normal temperature gas-refrigerant flows into a connecting pipeline of a normal temperature gas-refrigerant return box (93) and the normal temperature gas-refrigerant return box (8); the process is recycled reciprocally; a heat-carrying agent flows into a hot water storage tank (711), and an ice/hot water energy storage tank (811) in sequence via a heat-carrying agent cycling pump (9) and a connecting pipeline (94) for outputting the heat-carrying agent; after heat being discharged from the heat-carrying agent in the ice/hot water energy storage tank (811) by exchange of the hot water storage tank (711), the heat-carrying agent flows into a connecting pipeline (95) for returning the heat-carrying agent and then a heat-carrying agent return box (14); above process are cyclically repeated; a cooling medium flows into a connecting pipeline (96) for outputting the cooling medium, a refrigerator (304) with the cooling medium as a cold source, a draught fan (312C) with the cooling medium as a cold source, a dual-purpose machine (351) with the cooling medium as a cold source, a dual source heat-exchanger cold pipe (L) of a cold-dry air heater/cooler (512C), and the ice/hot water energy storage tank (811) in sequence via a cooling medium cycling pump (16); after cold being discharged from cooling medium in the ice/hot water energy storage tank (811) by exchange of the hot water storage tank (711), the cooling medium flows into a connecting pipeline (97) for returning the cooling medium/a storage box connecting pipeline (98) for the cooling medium/the heat-carrying agent, and then into a cooling medium return box (18); above process are cyclically repeated. Hot water of a heat accumulator (506) with water condensation flows from a heat-carrying agent outlet (10) into the dual source heat-exchanger heat pipe (R) of the cold-dry air heater/cooler (512C), and then into the heat accumulator (506) with the water condensation; above process are cyclically repeated; when the main system is under a working condition of excessive heat, the cloud-networked microprocessor controller (01) instructs a solenoid control valve (653)/a conversion solenoid valve (13) for returning the heat-carrying agent to be interchangeably connected, enabling a cold/heat balance heat exchanger (22), a dual component cold/heat balance self-defrosting heat exchanger (722), a dual component and dual pipeline cold/heat balance self-defrosting heat exchanger (822), a high pressure and high temperature refrigerant connecting pipeline (90) to discharge heat; when the main system is under a working condition of excessive cold, the cloud networked microprocessor controller (01) instructs to communicate the connecting pipeline (96) for outputting cooling medium/a connecting pipeline (92) for outputting the normal temperature liquid-refrigerant, the cold/heat balance heat exchanger (22), the dual component cold/heat balance self-defrosting heat exchanger (722), and the dual component and dual pipeline cold/heat balance self-defrosting heat exchanger (822) discharge cold; when the cold/heat balance heat exchanger (22), the dual component cold/heat balance self-defrosting heat exchanger (722), and the dual component and dual pipeline cold/heat balance self-defrosting heat exchanger (822) are under a working condition of frosting, and the cloud networked microprocessor controller (01) instructs the heat-carrying agent return conversion solenoid valve (13) to interchangeably connect with the a solenoid control valve (653). The cold/heat balance heat exchanger (22), the dual component cold/heat balance self-defrosting heat exchanger (722), and the dual component and dual pipeline cold/heat balance self-defrosting heat exchanger (822) perform cross-transforming of discharging, defrosting, an A assembly, and an B assembly, so as to discharge cold and defrost continuously; a solenoid regulation and control valve (723) converts a storage of cold/heat to a compensation of cold/heat on the basis of instructions of the cloud-networked microprocessor controller (01), the cold-dry air heater/cooler (512C) runs . . . . The cloud-networked microprocessor controller (01) instructs to connect the dual source heat-exchanger cold pipe (L) to provide cold air for a dry-hot/cold air outlet (89)/the cloud-networked microprocessor controller (01) instructs to connect the dual source heat-exchanger heat pipe (R) to provide hot air for the dry-hot/cold air outlet (89)/the cloud-networked microprocessor controller (01) instructs to connect the dual source heat-exchanger cold pipe (L) and the dual source heat-exchanger heat pipe (R) simultaneously, so as to provide cold-dry air for the dry-hot/cold air outlet (89); a dual component and dual temperature region cold/heat balance self-defrosting heat exchanger (512CD) runs; when the main system is under the working condition of excessive heat, and the cloud-networked microprocessor controller (01) instructs to connect the dual source heat-exchanger heat pipe (R) to discharge heat; when the main system is under the working condition of excessive cold, the cloud-networked microprocessor controller (01) instructs to connect the dual source heat-exchanger cold pipe (L) to discharge cold; when the main system is under the working condition of frosting, the cloud-networked microprocessor controller (01) instructs the dual component and dual temperature region cold/heat balance self-defrosting heat exchanger (512CD) to perform cross-transforming of discharging cold (L), defrosting (R). The A assembly (A), and the B assembly (B) so as to discharge cold and defrost continuously; the dual component and dual pipeline cold/heat balance self-defrosting heat exchanger (822), and the dual component and dual temperature region cold/heat balance self-defrosting heat exchanger (512CD) operates anti-frosting; the cloud-networked microprocessor controller (01) instructs to connect the cold and the heat of a cold and heat dual source simultaneously to control a working temperature of heat exchange of a cold/heat balance self-defrosting heat exchanger at an anti-frosting working condition; and the cloud-networked microprocessor controller (01) leads a network to a network cloud-networked microprocessor controller (02) and a network cloud-networked microprocessor controller (03) . . . , such that a plurality of functions of cold/heat balance, storage, and compensation are in combination of centralization and decentralization; and comprehensive balance and cross-use improve the efficiency.

Figure 3:
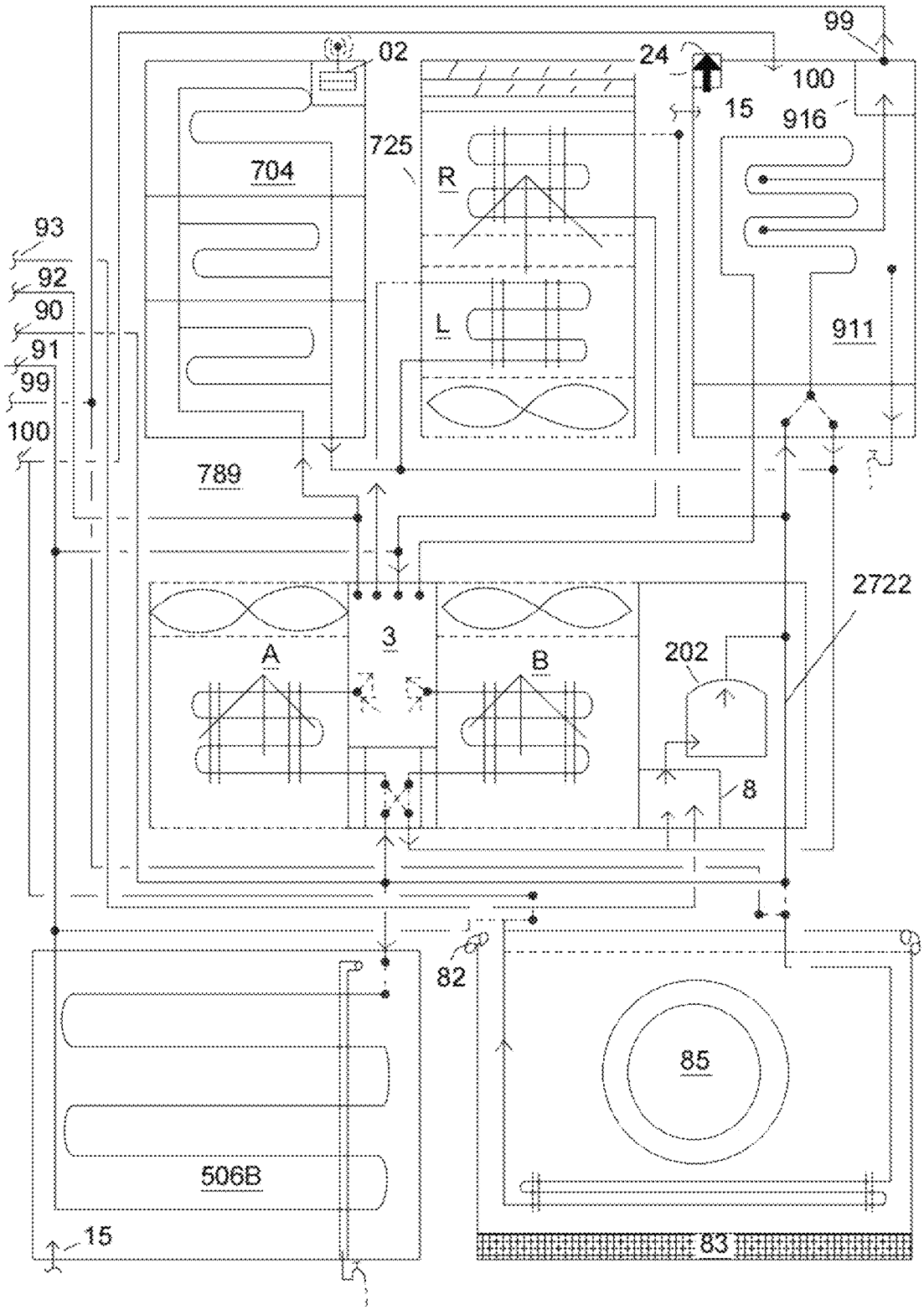
FIG. 3 is a schematic operation diagram of a refrigerator-air conditioner-water heater multi-purpose machine (789) of an easy-to-install multi-purpose cooling and heating machine system according to another embodiment of the present disclosure.

In FIG. 3, an operation method of a refrigerator-air conditioner-water heater multi-purpose machine (789) of a system of an easy-to-install multi-purpose cooling/heating machine system is provided, the operation method includes the following steps.

A cloud-network microprocessor controller (02) starts; a cooling system starts to operate; a normal temperature gas-refrigerant is sucked from a normal temperature gas-refrigerant return box (8) by a refrigeration compressor (202); a high temperature and high pressure gas-refrigerant is compressed and discharged via the refrigeration compressor (202) to enable the high temperature and high pressure gas-refrigerant to flow into a self-cycling hot/cold water storage tank (911), a dual temperature region cold-dry hot/cold air conditioner indoor unit (725), a water heater (506B) with condensation storage, and a drying cabinet (85) in sequence through a high pressure and high temperature refrigerant connecting pipeline (90); after the high temperature and high pressure gas-refrigerant in the drying cabinet (85) being condensed and heated to form a normal temperature liquid-refrigerant, the normal temperature liquid-refrigerant flows into a connecting pipeline of a refrigerant distribution box (91), a large capacity refrigerant distribution box (3), a connecting pipeline (92) for outputting the normal temperature liquid-refrigerant, a refrigerator (704), a water heater with condensation and storage function, a self-cycling hot/cold water storage tank (911), and a dual temperature region cold-dry hot/cold air conditioner indoor unit (725) in sequence; after the normal temperature liquid-refrigerant in the dual temperature region cold-dry hot/cold air conditioner indoor unit (725) being evaporated and refrigerated to form a normal temperature gas-refrigerant, the normal temperature gas-refrigerant flows into a connecting pipeline of a normal temperature gas-refrigerant return box (93) and the normal temperature gas-refrigerant return box (8); above process are cyclically repeated; when the main system is under a working condition of excessive heat, the cloud-networked microprocessor controller (02) instructs to connect a self-balancing defrosting cold/heat output machine (2722), an A assembly (A), the high pressure and high temperature refrigerant connecting pipeline (90); the normal temperature liquid-refrigerant flows into a connecting pipeline of a refrigerant distribution box (91) to discharge heat; when the main system is under a working condition of excessive cold, the cloud-networked microprocessor controller (02) instructs to connect the self-balancing defrosting cold/heat output machine (2722), the A assembly (A), the connecting pipeline (92) for outputting the normal temperature liquid-refrigerant, and the connecting pipeline to the normal temperature gas-refrigerant return box (93) to discharge cold; when the main system is under a working condition of frosting, and the cloud-networked microprocessor controller (02) instructs to connect the self-balancing defrosting cold/heat output machine (2722) to perform cross-transforming of discharging cold, defrosting, the A assembly (A), and an B assembly (B) so as to discharge cold and defrost continuously; the cloud-networked microprocessor controller (02) is networked to the cloud-networked microprocessor controller (01) and a cloud-networked microprocessor controller (03) . . . , such that a plurality of functions of cold/heat balance, storage, and compensation are in combination of centralization and decentralization; and comprehensive balance and cross-use improve the efficiency.

Figure 4:
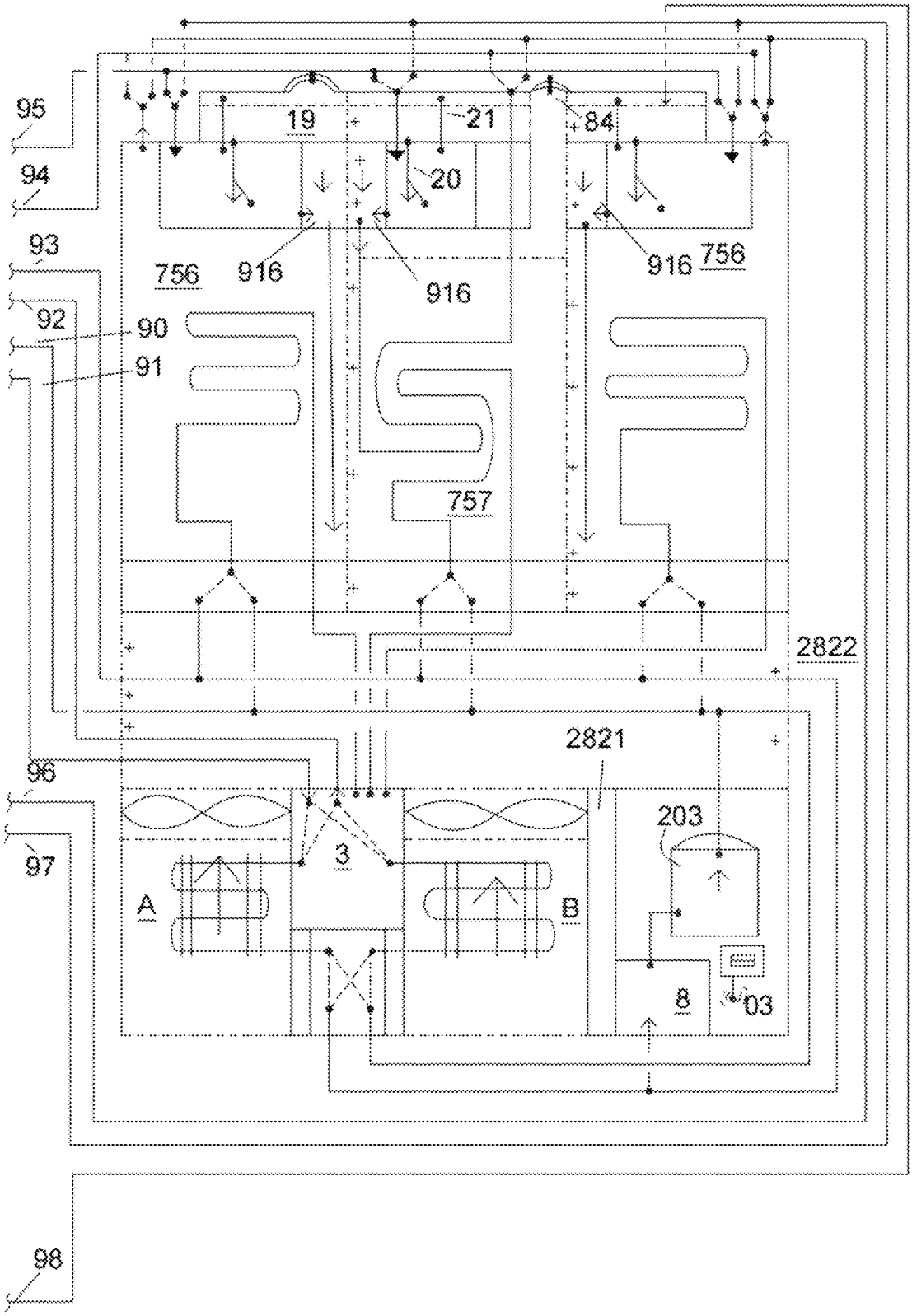
FIG. 4 is a schematic operation diagram of an easy-to-install multi-purpose cold/heat output machine (2822) of an easy-to-install multi-purpose cooling and heating machine system according to yet another embodiment of the present disclosure.

In FIG. 4, an operation method an easy-to-install multi-purpose cold/heat output machine (2822) of a system of an easy-to-install multi-purpose cooling/heating machine is provided, the method includes the following steps.

A cloud-networked microprocessor controller (03) instructs to start; a refrigerating system starts to operate; a normal temperature gas-refrigerant is sucked from a normal temperature gas-refrigerant return box (8) by a refrigeration compressor (203); a high temperature and high pressure gas-refrigerant is compressed and discharged via the refrigeration compressor (203) to enable the high temperature and high pressure gas-refrigerant to flow into a cold/heat storage tank (756), an ice/hot water storage tank (757), and the cold/heat storage tank (756) in sequence through the high pressure and high temperature refrigerant connecting pipeline (90); after the high temperature and high pressure gas-refrigerant in the connecting pipeline (90) being condensed and heated to form a normal temperature liquid-refrigerant, the normal temperature liquid-refrigerant flows into a connecting pipeline of a refrigerant distribution box (91), a large capacity refrigerant distribution box (3), a connecting pipeline (92) for outputting the normal temperature liquid refrigerant, the cold/heat storage tank (756), the ice/hot water storage tank (757), and the cold/heat storage tank (756) in sequence; after the normal temperature liquid-refrigerant in the cold/heat storage tank (756) being evaporated and refrigerated to form a normal temperature gas-refrigerant, the refrigerant flows into a connecting pipeline of a normal temperature gas-refrigerant return box (93) and the normal temperature gas-refrigerant return box (8); above process are cyclically repeated; when the main system is in a working condition of excessive heat, the cloud networked microprocessor controller (03) instructs to connect a self-balancing defrosting cold/heat output machine (2821), an A assembly (A), the high pressure and high temperature refrigerant connecting pipeline (90), and the normal temperature liquid-refrigerant flows into a connecting pipeline of a refrigerant distribution box (91) to discharge heat; when the main system is under a working condition of excessive cold, and the cloud-networked microprocessor controller (03) instructs to connect the self-balancing defrosting cold/heat output machine (2821), the A assembly (A), the connecting pipeline (92) for outputting the normal temperature liquid refrigerant, and the connecting pipeline to the normal temperature gas-refrigerant return box (93) to discharge cold; when the main system is under a working condition of frosting, the cloud-networked microprocessor controller (03) instructs to connect the self-balancing defrosting cold/heat output machine (2821) to perform cross-transforming of discharging cold, defrosting, the A assembly, and an B assembly to discharge cold and defrost continuously; the easy-to-install multi-purpose cold/heat output machine (2822) is split/integrated, or the easy-to-install multi-purpose cold/heat output machine (2822) is enabled to have a plurality of combination modes, each of the cold/heat storage tank (756), the ice/hot water storage tank (757), and the self-balancing defrosting cold/heat output machine (2821) is a split/combined part; and the cloud-networked microprocessor controller (03) is networked to a cloud-networked microprocessor controller (01) and a cloud-networked microprocessor controller (02) . . . such that a plurality of functions of cold/heat balance, storage, and compensation are in combination of centralization and decentralization; and comprehensive balance and cross-use improve the efficiency.

To sum up, the embodiments and principle are illustrated by using specific examples in the present disclosure. The present disclosure provides a cool and heat conversion system. The number of refrigeration compressors and cloud-networked microprocessor controllers can be flexibly configured according to requirements. And the number of multi-purpose refrigerating and heating machine terminals or the networked host machines and auxiliary machines can be dynamically increased or decreased, and then these devices can be networked.

What is claimed is:

1. An easy-to-install multi-purpose cooling/heating machine system comprising:

a cloud-networked microprocessor controller, a refrigeration compressor, a refrigerant return box, a cold-dry air heater/cooler, a dual source heat-exchanger heat pipe, a heat accumulator with water condensation, a condensation heat accumulator, refrigerant distribution box, four connecting pipelines, an evaporator/cold accumulator, a refrigerator and/or an air conditioner indoor unit;

wherein, the cloud-networked microprocessor controller instructs a refrigerating system to run, the refrigeration compressor sucks and compresses a refrigerant from the refrigerant return box, the refrigerant flows into the cold-dry air heater/cooler, the dual source heat-exchanger heat pipe, the heat accumulator with water condensation and the condensation heat accumulator in sequence through a first connecting pipeline, so that the refrigerant is condensed and heated;

wherein the refrigerant flows into the refrigerant distribution box through a second connecting pipeline, flows into the evaporator/cold accumulator, the refrigerator and/or the air conditioner indoor unit in sequence via a third connecting pipeline for evaporation and refrigeration, and flows into the refrigerant return box via a fourth connecting pipeline.

2. The easy-to-install multi-purpose cooling/heating machine system of claim 1, further comprising:

a first cycling pump, a hot water storage tank, an ice/hot water energy storage tank, a heat-carrying agent return box, a second cycling pump, a refrigerator with a cooling medium as a cold source, a draught fan with the cooling medium as a cold source, a dual-purpose machine with the cooling medium as a cold source;

wherein a heat-carrying agent is output via the first cycling pump, flows into the hot water storage tank and the ice/hot water energy storage tank via a fifth connecting pipe to exchange and release heat, and flows into the heat-carrying agent return box via a sixth connecting pipe;

wherein a cooling medium is output via a second cycling pump and flows into the refrigerator with the cooling medium as a cold source, the draught fan with the cooling medium as a cold source, the dual-purpose machine with the cooling medium as a cold source, and the cold-dry air heater/cooler in sequence via a seventh connecting pipeline;

wherein when a dual source heat-exchanger cold pipe of the cold-dry air heater/cooler and the ice/hot water energy storage tank exchange and discharge cold, the cooling medium flows into a cooling medium return box via an eighth connecting pipeline and a ninth connecting pipeline, hot water in the heat accumulator with water condensation flows into the dual source heat-exchanger heat pipe of the cold-dry air heater/cooler and exchanges heat, and returns the heat accumulator with water condensation.

3. The easy-to-install multi-purpose cooling/heating machine system of claim 1, wherein, when the system is under a working condition of excessive heat, the cloud-networked microprocessor controller instructs a solenoid valve or a solenoid valve for connecting a cold/heat balance heat exchanger, a dual component cold/heat balance self-defrosting heat exchanger and a dual component and dual pipeline cold/heat balance self-defrosting heat exchanger to discharges the heat;

when the system is under a working condition of excessive cold, the cloud-networked microprocessor controller instructs to communicate a connecting pipeline of cooling medium and a connecting pipeline of refrigerant, the system discharges the cold via the cold/heat balance heat exchanger, the dual component cold/heat balance self-defrosting heat exchanger, and the dual component and dual pipeline cold/heat balance self-defrosting heat exchanger;

when the cold/heat balance heat exchanger, the dual component cold/heat balance self-defrosting heat exchanger, and the dual component and dual pipeline cold/heat balance self-defrosting heat exchanger are under a working condition of frosting, the cloud-networked microprocessor controller instructs the cold/heat balance heat exchanger, the dual component cold/heat balance self-defrosting heat exchanger and the dual component and dual pipeline cold/heat balance self-defrosting heat exchanger to discharge the cold and defrost via cross-transforming of a first assembly of heat exchanger and a second assembly of heat exchanger.

4. The easy-to-install multi-purpose cooling/heating machine system of claim 1, wherein the cloud-networked microprocessor controller controls all parts of cooling/heating conversion system to be networked for intelligent monitoring and scheduling.

5. A cooling/heating conversion and output device of an easy-to-install multi-purpose cooling/heating machine system, comprising:

a cloud-networked microprocessor controller, a refrigeration compressor, a refrigerant return box, a cold/hot storage tank, an ice/hot water energy storage tank and a refrigerant distribution box;

wherein the cloud-networked microprocessor controller controls a refrigerating system to operate, the refrigeration compressor sucks and compresses a refrigerant from the refrigerant return box, the refrigerant flows into the cold/hot storage tank and the ice/hot water energy storage tank via a first connecting pipeline to be condensed and heated; and then the refrigerant flows into the refrigerant distribution box via a second connecting pipeline, flows into the cold/hot storage tank and the ice/hot water energy storage tank via a third connecting pipeline for evaporation and refrigeration, and flows into the refrigerant return box via a fourth connecting pipeline.

6. The cooling/heating conversion and output device of the easy-to-install multi-purpose cooling/heating machine system of claim 5, further comprising:

a first assembly of a heat exchanger, a second assembly of the heat exchanger;

when the system is under a working condition of excessive heat, the cloud-networked microprocessor controller instructs the first connecting pipeline to connect with the first assembly of the heat exchanger to discharge the heat to flow into the refrigerant distribution box via the second connecting pipeline;

when the system is under a working condition of excessive cold, the cloud-networked microprocessor controller instructs the first assembly of the heat exchanger to connect with the third connecting pipeline to discharge the cold to flow into the refrigerant distribution box via the fourth connecting pipeline;

when the system is under a working condition of frosting, the cloud-networked microprocessor controller instructs self-defrosting cold/heat output device to discharge the cold and defrost, and the cloud-networked microprocessor controller instructs the cross-transforming of the first assembly of the heat exchanger and the second assembly of the heat exchanger to discharge the cold and defrost.

7. The cooling/heating conversion and output device of the easy-to-install multi-purpose cooling/heating machine system of claim 5, wherein the cold/hot storage tank and the ice/hot water energy storage tank are modular components, which are combined as required, or applied alone.

* * * * *